US011125541B2

(12) United States Patent
Wilton

(10) Patent No.: US 11,125,541 B2
(45) Date of Patent: Sep. 21, 2021

(54) MODULAR CHARGE CONTAINER

(71) Applicant: BAE SYSTEMS plc, London (GB)

(72) Inventor: Anne Marie Wilton, Renfrewshire Strathclyde (GB)

(73) Assignee: BAE SYSTEMS plc, London (GB)

( * ) Notice: Subject to any disclaimer, the term of this patent is extended or adjusted under 35 U.S.C. 154(b) by 157 days.

(21) Appl. No.: 16/347,231

(22) PCT Filed: Oct. 19, 2017

(86) PCT No.: PCT/GB2017/053160
§ 371 (c)(1),
(2) Date: May 3, 2019

(87) PCT Pub. No.: WO2018/083440
PCT Pub. Date: May 11, 2018

(65) Prior Publication Data

US 2019/0277606 A1 Sep. 12, 2019

(30) Foreign Application Priority Data

Nov. 4, 2016 (GB) ..... 1618622

(51) Int. Cl.
*F42B 5/38* (2006.01)
*F42B 5/18* (2006.01)
*F42B 3/02* (2006.01)

(52) U.S. Cl.
CPC ..... *F42B 5/38* (2013.01); *F42B 3/02* (2013.01); *F42B 5/18* (2013.01)

(58) Field of Classification Search
CPC ..... F42B 3/02; F42B 5/16; F42B 5/18; F42B 5/188; F42B 5/192; F42B 5/38; F42B 5/00; F42D 1/02
(Continued)

(56) References Cited

U.S. PATENT DOCUMENTS 2,419,949 A 5/1947 Hottinger
2,432,706 A 12/1947 Anderson et al.
(Continued)

FOREIGN PATENT DOCUMENTS

AU 778762 B1 12/2004
CA 2990862 A1 1/2017
(Continued)

OTHER PUBLICATIONS

International Search Report and Written Opinion received for PCT Application No. PCT/GB2017/053160. dated Dec. 21, 2017. 11 pages.
(Continued)

*Primary Examiner* — James S Bergin
(74) *Attorney, Agent, or Firm* — Finch & Maloney PLLC

(57) ABSTRACT

The invention relates to a modular charge container device formed of one or more combustible modular cartridges, wherein said combustible modular cartridge comprises two ends, a first end comprising a base portion and a second end comprising a top portion, wherein the combustible modular cartridge is formed using a substantially rigid and combustible material, said combustible modular cartridge comprises at least one wall to define a cavity, wherein the cavity further comprises at least one combustible canister, wherein said combustible canister comprises an energetic material.

16 Claims, 7 Drawing Sheets

(58) Field of Classification Search
USPC ..... 102/282
See application file for complete search history.

(56) References Cited

U.S. PATENT DOCUMENTS

| | | | | | |
|---|---|---|---|---|---|
| 3,407,735 | A | | 10/1968 | Walter | |
| 3,696,748 | A | * | 10/1972 | Picard | F42B 5/18 102/431 |
| 3,713,395 | A | * | 1/1973 | Carpenter | F02K 9/36 102/290 |
| 3,734,020 | A | * | 5/1973 | Ciccone | F42B 5/16 102/443 |
| 4,709,636 | A | | 12/1987 | Mueller et al. | |
| 5,090,323 | A | | 2/1992 | Kallevig et al. | |
| 5,212,342 | A | | 5/1993 | Eches et al. | |
| 5,263,416 | A | | 11/1993 | Amundson et al. | |
| 5,282,423 | A | | 2/1994 | Sikorski et al. | |
| 6,305,288 | B1 | | 10/2001 | Nilsson et al. | |
| 6,666,141 | B2 | | 12/2003 | Hagerty | |
| 7,908,971 | B2 | * | 3/2011 | Gustafsson | F42B 5/05 102/437 |
| 8,561,541 | B2 | * | 10/2013 | Pfersmann | F42B 5/38 102/431 |
| 10,837,741 | B2 | * | 11/2020 | Wilton | F42B 5/18 |
| 2009/0266263 | A1 | | 10/2009 | Queensberry et al. | |
| 2019/0331467 | A1 | | 10/2019 | Wilton | |

FOREIGN PATENT DOCUMENTS

| | | | | | |
|---|---|---|---|---|---|
| DE | 1123953 | | | 2/1962 | |
| DE | 3927400 | A1 | | 2/1991 | |
| FR | 803967 | | | 10/1936 | |
| FR | 2497335 | A1 | * | 7/1982 | F42B 5/38 |
| FR | 2684176 | A1 | | 5/1993 | |
| GB | 2284652 | A | | 6/1995 | |
| GB | 2555618 | A | * | 5/2018 | F42B 5/38 |
| JP | 3203573 | B2 | | 5/1996 | |
| JP | 2006071236 | A | | 3/2006 | |
| WO | 2018083439 | A1 | | 5/2018 | |
| WO | 2018083440 | A1 | | 5/2018 | |

OTHER PUBLICATIONS

GB Search Report under Section 17(5) received for GB Application No. 1618622.3 dated May 5, 2017. 3 pages.
International Preliminary Report on Patentability received for PCT Application No. PCT/GB2017/053159. dated May 7, 2019. 7 pages.
International Preliminary Report on Patentability received for PCT Application No. PCT/GB2017/053160. dated May 7, 2019. 8 pages.
International Search Report and Written Opinion received for PCT Application No. PCT/GB2017/053159. dated Dec. 21, 2017. 10 pages.
GB Search Report under Section 17(5) received for GB Application No. 1618624.9 dated May 5, 2017. 3 pages.

* cited by examiner

MODULAR CHARGE CONTAINER

The invention relates to a charge container, for use as a charge for propelling munitions, more specifically related to the area of modular charge containers.

Within the field of munitions a projectiles range may be achieved by utilising an explosive train sequence, which may comprise an igniter, a primer with an intermediate explosive and an output charge. The explosive train serves to take a small energetic event and amplify the output as it moves through the explosive train.

In military use, an explosive train sequence is often used in the launching of munitions, whether direct or indirect; to propel a shell over a distance, often considering a minimum launch distance to prevent injury to own troops or large distances to reach long range. To accomplish an explosive train sequence relating to a specific distance, an ignition means is incorporated alongside a charge, with additional charges being added or subtracted depending on the distance the shell is to travel.

The construction of an explosive train sequence may be carried out modularly; this can be done in a number of ways depending on the system used and various other user requirements or conditions (e.g. variations of distances where opposition forces are engaged).

One example of the use of a combination of charges to achieve a launch distance is to load modular charges individually into the breach until the desired total charge is achieved. Each charge contains an energetic material and is made from a rigid, combustible case and may be of different sizes, which correspond to a predetermined distance they are able to propel a shell. Each charge comprises a recessed and extruded portion to allow them to fit together as they are loaded into the breach in order to prevent adverse movement. In use the ignition means on the case (e.g. an igniter pad) is struck and causes an explosive train sequence to begin, which continues through the charges until the force expels the shell from the barrel of the weapon.

This method suffers as the explosives train is formed by utilising the individual charges loosely coupled together utilising the recess/extrusions provided, making rapid movement or formation of a desired charge time consuming. The charges themselves are also formed from a rigid outer case containing loose energetic material and as a result hold no flexibility for rapid change of energetic material quantity if needed.

Another example is utilising a chain of combustible bags, combustible in this context refers to the fact that the bags are fully consumed following burning, rather than providing further energetic output. These combustible bags are filled with a set quantity of energetic material, relating to different distances the shell is to be launched. These bags may be placed into a single, larger combustible bag (e.g. cotton), with an igniter pad at the base wherein the total number of bags contained within relate to a specific distance. Alternatively the number of required bags is placed in an initial combustible bag, which comprises a number of ties that may be brought up around the combustible bags to hold them in place. When required to be used the larger bag or combustible bag chain is taken and placed in its entirety into the breach. Upon firing the ignition begins the explosive train, which travels up through the bags, firing the shell over the desired distance and combusting the bag in the process, allowing the breach to be clear for the next shell and charge.

This method has significant cost savings and flexibility as the use of a large single bag to contain smaller charges means that a single bag, relating to a distance can be moved around and is not costly to produce. Its lack of rigid structure does however make handling difficult and a cotton material can be prone to snagging and tears. Further to this the adding of single bags to a larger container can be subject to human error and mistakes, such as the addition of the wrong charge or omission of a charge, may cause a launch to overshoot or undershoot its target. These human errors may increase during periods of high stress, such as conflict.

A final example involves a single full length master combustible bag with individual "elongate sticks" of energetic material contained in individual full length combustible bags. There is a selection of different combustible bags which are filled with different specific amounts of propellant. The sticks, once in their combustible bags are arranged to run the full length of the single master combustible bag. In use an ignition pad at the bottom of the single master combustible bag is struck and causes the "elongate sticks" of energetic material to react and burn from the base of the master bag up through the "elongate stick".

This method has the advantage that it is easier to add or remove the combustible bags of energetic material to the single master combustible bag. As a result the distance a shell is to travel may be adjusted as required. Like other methods however this method is prone to human error resulting in the incorrect arrangement of combustible bags or damage to the combustible bags during handling.

The invention herein aims to address the issues presented in the background prior art by solving issues in robustness, flexibility and usability.

According to a first aspect of this invention there is provided a modular charge container device formed of one or more combustible modular cartridges, wherein said combustible modular cartridge comprises two ends, a first end comprising a base portion and a second end comprising a top portion, wherein the combustible modular cartridge is formed using a substantially rigid and combustible material, said combustible modular cartridge comprises at least one wall to define a cavity, wherein the cavity further comprises at least one combustible canister, wherein said combustible canister comprises an energetic material.

The said modular combustible cartridge may be produced as a single unit, preferably each modular cartridge is of fixed length and diameter, such that the dimensions are determined depending on the breach it is designed to fit and the amount and type of energetic material the combustible cartridge is intended to hold.

A plurality of modular combustible cartridges may be stacked one on top the other, to produce a modular charge container device, for use in a breach to project the round or shell.

The combustible cartridge is constructed from a rigid and combustible material, such as a cardboard impregnated with an energetic substance for example, which allows the combustible cartridge to be moved easily. The combustible cartridge will combust to leave substantially no residue after the firing event to prevent the need to clean the barrel or remove debris prior to loading a new shell, combustible modular cartridges or charge container.

In one arrangement of the combustible modular cartridge's base portion comprises a base cover with an aperture therein, wherein said base cover may comprise a recessed portion to allow the insertion of a protrusion on the surface of a top portion of a further combustible modular cartridge. This will allow further combustible modular cartridges to be added or removed to create the desired final length of modular charge container, so as to form the required effect of the explosive train as necessary, depending on the distance that the shell is to travel. The addition or removal of combustible modular cartridges may be achieved by the insertion or removal of the top portion of one of the combustible modular cartridges into another as they are formed to be placed into the breach.

In a further arrangement the base cover and top cover may comprise mating surfaces to provide cooperative engagement between said top cover and base cover.

The mating surfaces may be provided by co-operatively engaged protrusion and recessed portions, and may be swapped in design to allow a protrusion on the base of the combustible modular cartridge to be slotted into a recess on the top portion of the combustible modular cartridge.

In a further arrangement both top portion and base portion may comprise an abrasive surface or a surface with raised portions to increase the co-efficiency of friction of the two surfaces in order that when a top portion and a base portion are in contact they are sufficiently resilient to movement.

In an further arrangement subsequent combustible modular cartridges may be joined to adjacent combustible modular cartridges by a releasable means, or reversible locking engagement means, such as, for example a hook and loop arrangement (e.g. Velcro) or a press and lock arrangement. A yet further example may be provided by utilising a hook on either the top portion or base portion that would engage with a recessed bar on the top portion or base portion of a connecting combustible modular cartridge.

The combustible modular cartridge' wall defines a cavity, which houses a combustible canister therein. The combustible canister contains a set amount of energetic material; said amount of energetic material may be dependent on the distance required of the propelled munition (e.g. a shell). This amount will relate directly to a designation on the combustible modular cartridge to allow selection for use in an explosive train.

In a preferred arrangement each combustible canister has a uniform mass of propellant such that a set number of increments may be selected.

The combustible container may be formed from a rigid material similar to that of the cartridge case (e.g. cardboard), however in a preferred embodiment will be a flexible material such as cotton, as it is cheaper and faster to manufacture as well as providing a simpler system to add the energetic material. This provides a further advantage, allowing a flexibility to manage energetic material quantity, preventing over-ordering and potential wastage.

The combustible canister may be housed in the cavity, preferably utilising a releasable attaching means to the wall of the combustible modular cartridge. The releasable means may comprise a hook and loop releasable attachment (e.g. Velcro).

In a further arrangement the combustible container may be held in place by one or more spacers attached to the wall of the combustible modular cartridge. The spacers may hold each added combustible canister in place, providing a gap allowing for the propagation of a flame front in the gap between the combustible canister and the combustible modular cartridge. The gap may be greater than 1 mm and preferably in the range of from 1 mm to 30 mm, more preferably 1 mm to 10 mm. The use of spacers provides a more uniform burn as the flame front can propagate in the gap, and hence a more uniform explosive energy output from the combustible modular cartridge may be achieved. The gap may provide a path for both thermal output and flame propagation, allowing the device to utilise the areas created by the spacers to ensure even ignition of the combustible modular cartridge and energetic material within the combustible canister.

The combustible canister comprises at least one energetic material, which may be a material such as a pyrotechnic, propellant or high explosive composition.

The addition of energetic material to a combustible canister either within the cartridge or prior to addition to the cartridge has a number of advantages. It allows the amount of energetic material within a cartridge to be adapted as required, without the need to manage the energetic material directly, which may lead to incorrect amounts of energetic material being added and allows a single cartridge size to have differing effects as needed. It also allows the indirect management of the energetic material spacing as the combustible canister may be manipulated into position to provide a gap for the flame front (for example) or wrapped around (or space provided for) a central igniter.

The base portion of the combustible modular cartridge may comprise an igniter pad, said igniter pad being present to aid in the initiation of the explosive train and in a preferred arrangement will contain an energetic material such as a propellant or pyrotechnic.

In an alternative arrangement ignition is achieved utilising a central igniter, comprising a propellant or pyrotechnic and running from the base portion to the top portion of the combustible modular cartridge. This central igniter allows an even ignition to the energetic material within the combustible canister.

Whilst the invention has been described above, it extends to any inventive combination of the features set out above, or in the following description, drawings or claims.

Exemplary embodiments of the device in accordance with the invention will now be described with reference to the accompanying drawings in which:—

FIGS. 3*a*, 3*b*, 3*c* and 3*d* show a number of views of the combustible modular cartridge with 3*a* showing a plurality of combustible modular cartridges arranged cooperatively attached, 3*b* shows a cross-section of 3*a*, 3*c* shows a top-down view of a single combustible modular cartridge and 3*d* shows a bottom up view of a single combustible modular cartridge.

Figure 4A:
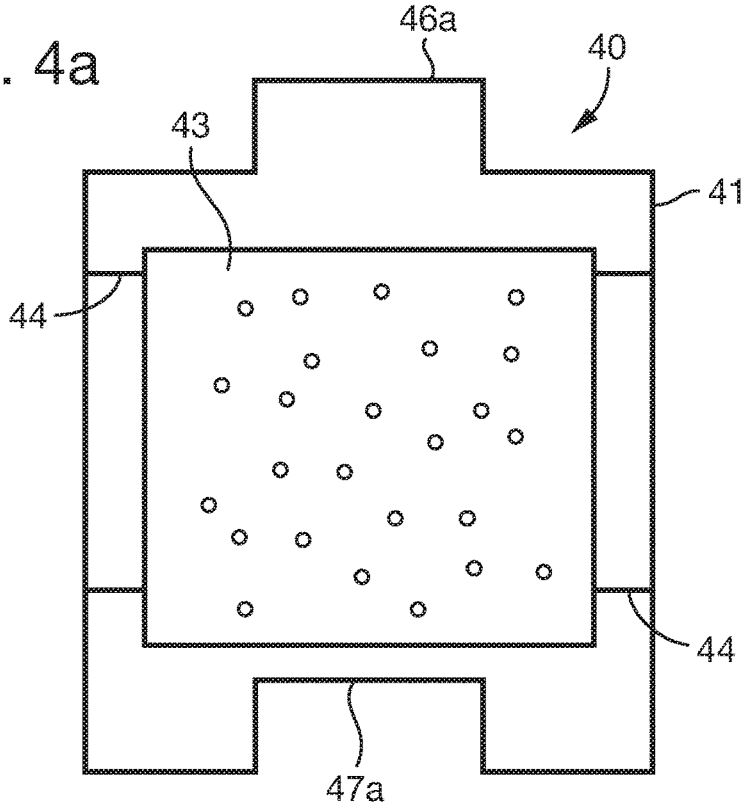
Figure 4B:
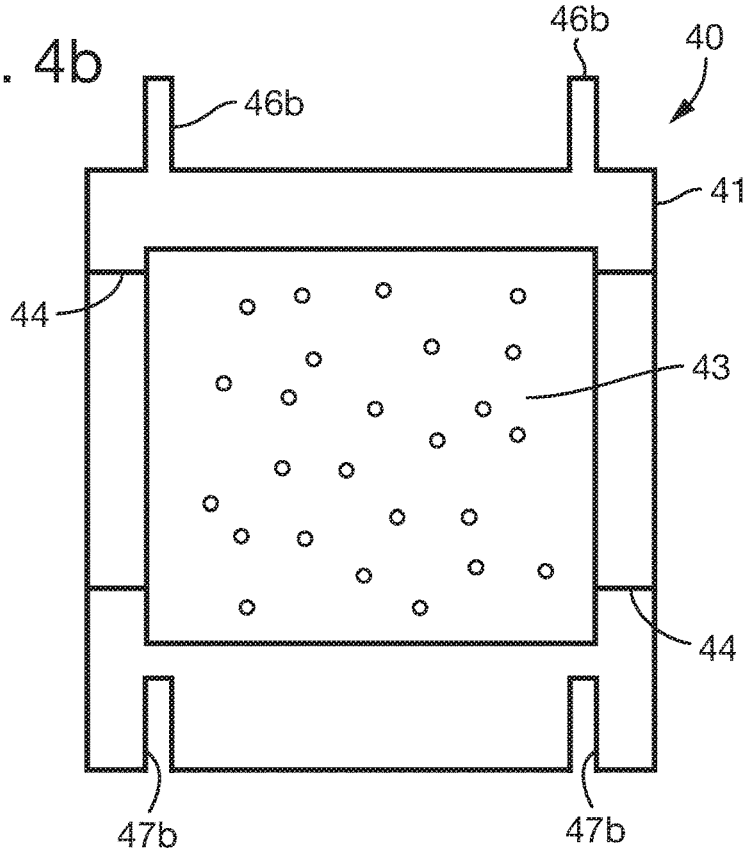

FIGS. 4*a* and 4*b* show a cross section of an embodiment of the combustible modular cartridge with differing cooperative attachment means.

Figure 5A:
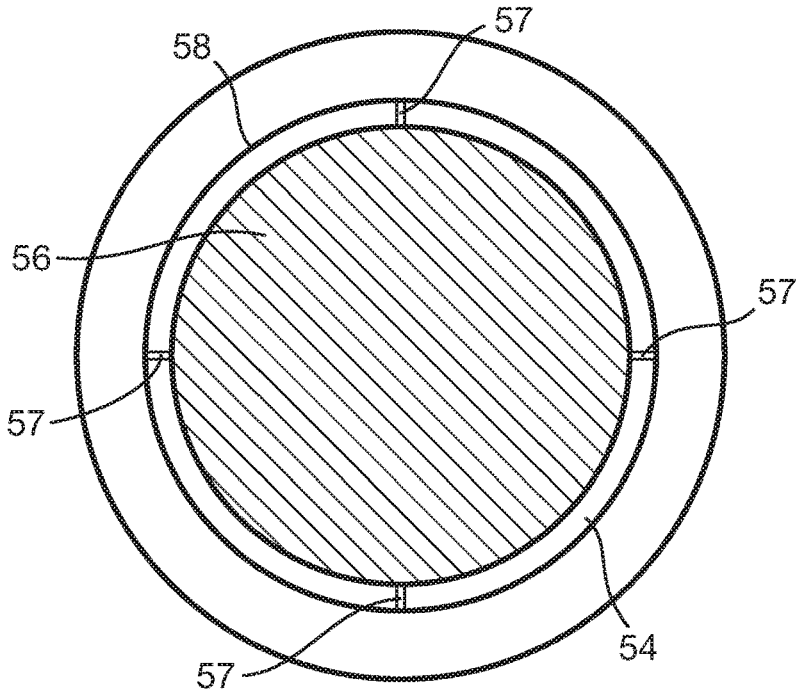
Figure 5B:
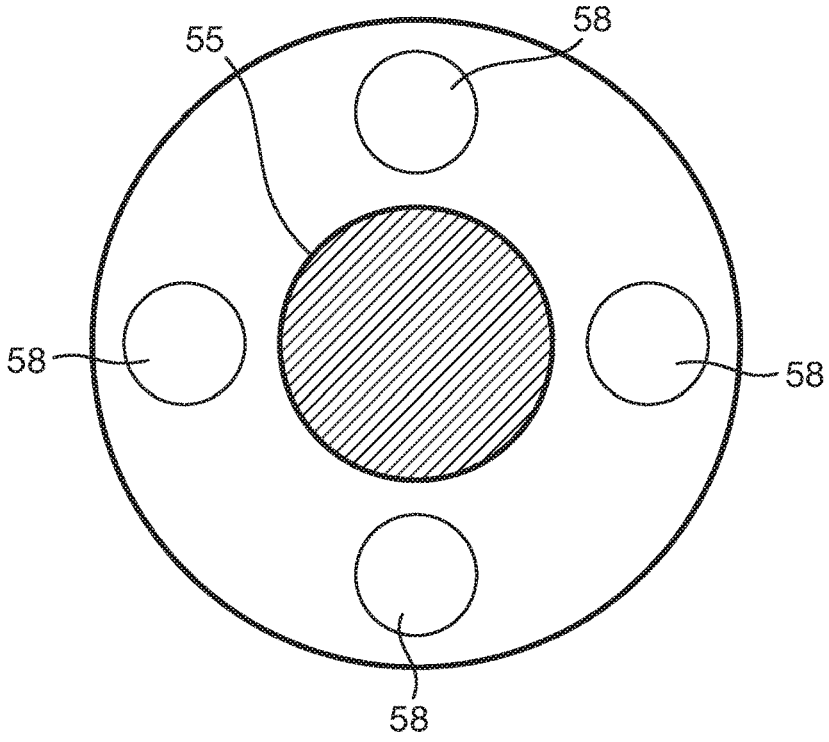

FIGS. 5*a* and 5*b* show a top-down view of the combustible modular cartridge in alternative arrangements.

Figure 6:
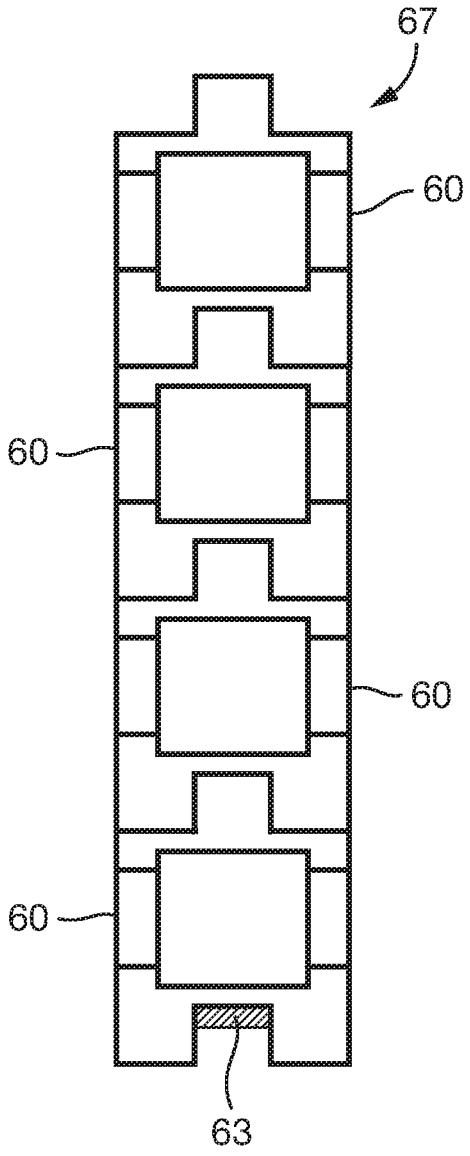

FIG. 6 shows a schematic of a plurality of coaxially aligned combustible modular cartridges, arranged in a stacked arrangement.

Figure 1:
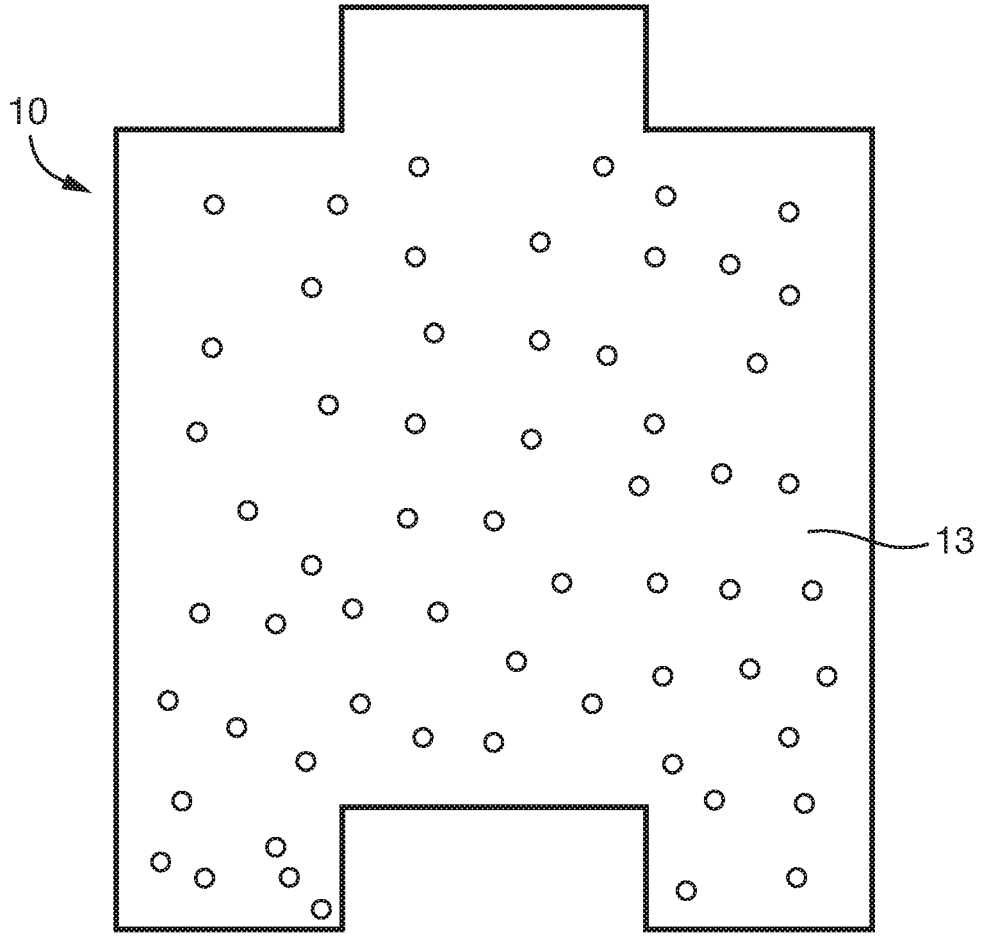
Fig. 1 (Prior Art)
FIG. 1 shows a schematic view of a prior-art cartridge with energetic material contained within.

Referring to FIG. 1, there shows a prior art arrangement wherein energetic material 13 is loosely contained within a charge 10, shaped to be co-operably engaged with charges of the same type. In this prior art embodiment, no separate container of energetic material is used. As a result energetic material 13 is left loose within the charge 10, preventing any ability to accurately adapt or modify the charge yield if required. Further to this no management of the explosive train is presented by the use of a gap between the energetic material and the wall of the charge.

Figure 2:
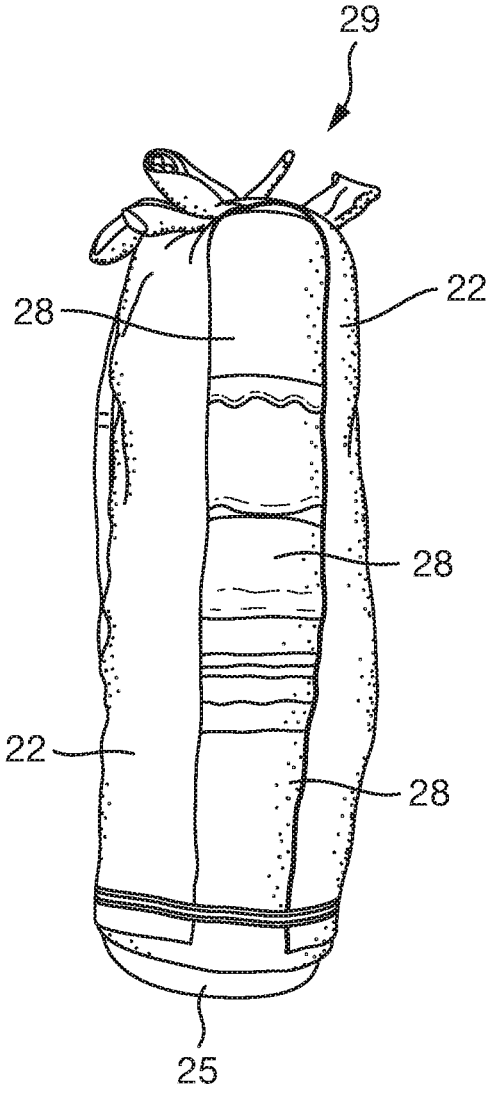
Fig. 2 (Prior Art)
FIG. 2 shows the design currently in use.

FIG. 2 shows a further prior art arrangement which comprises individual combustible bags 28 being placed in a stacked arrangement to form the output charge 29. The combustible bags 28 may be held in place to prevent movement by a base 25 and strips of combustible material 22, which are tied in a knot to hold the combustible bags in the stacked arrangement. This method provides little to no stability during movement of the plurality of combustible bags 28.

Figure 3A:
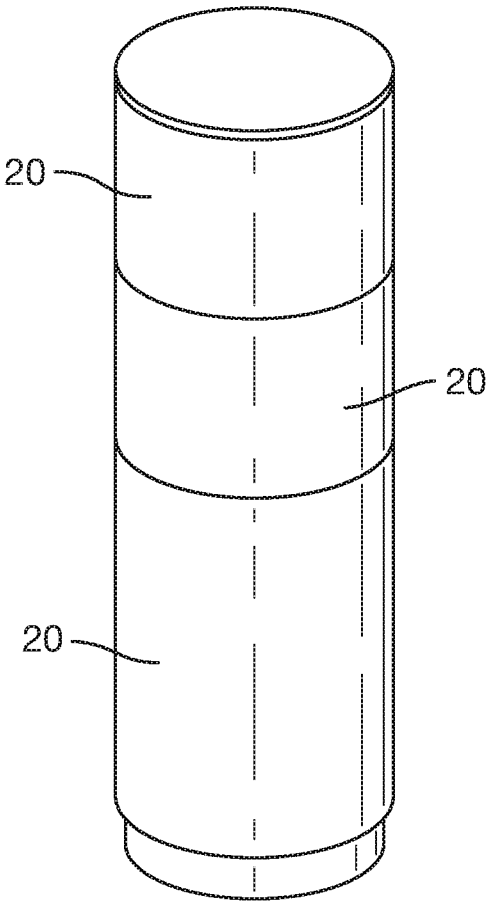
Figure 3B:
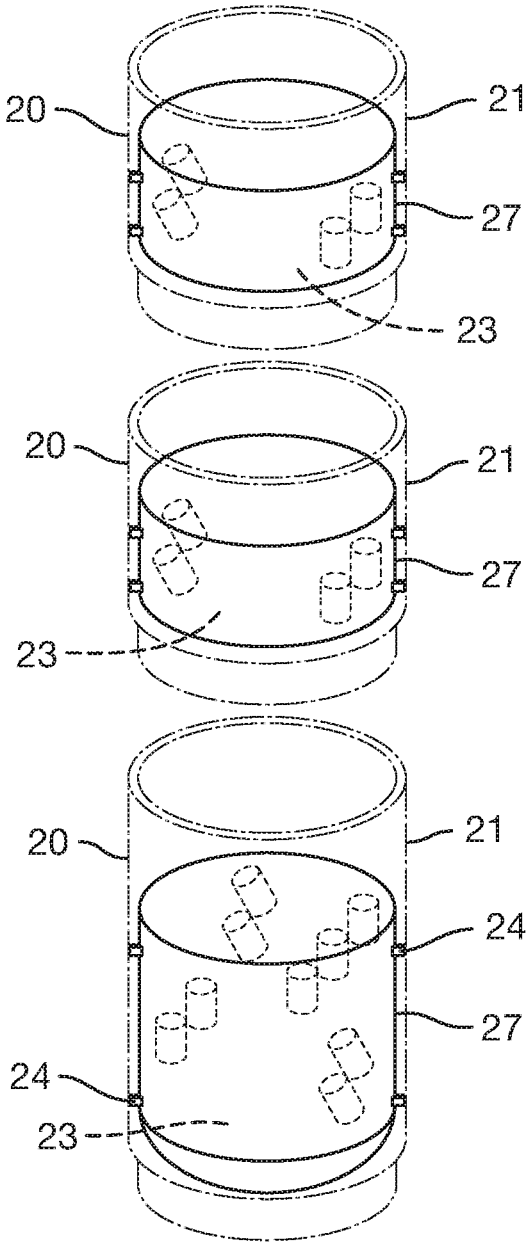

FIGS. 3*a* and 3*b* show a stacked arrangement according to the invention. There is a plurality of combustible modular cartridges 20, wherein each combustible modular cartridge is cooperatively engaged with a further combustible modular cartridge 20, which may be located either above or below. The combustible modular cartridges 20 comprise a combustible canister 23, located therein. The combustible canister 23 comprises an energetic material, such as a grain or stick propellant. The combustible canister 23 may be reversibly attached to the combustible modular cartridge at least one wall 21 by a reversible means 24, in order to form a gap 27. The shape and rigidity of the combustible modular cartridge 20 allows for ease of movement, stability of storage and an ability to increase or decrease the number of combustible modular cartridges 20 depending on the output required.

Figure 3C:
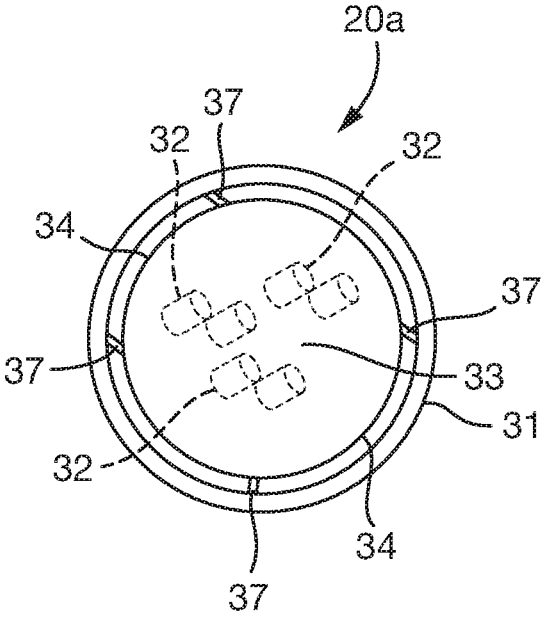
Figure 3D:
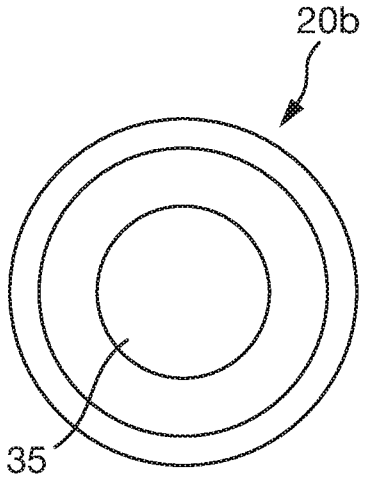

Referring to FIG. 3*c*, there shows a combustible modular cartridge top 20*a* comprising a combustible modular cartridge at least one wall 31, a combustible canister 33 located in the cavity, said combustible canister 33 comprising energetic material 32 and a plurality of spacers 37. The spacers 37 provide a gap 34 between the at least one wall 31 and the combustible canister 33. The combustible canister 33 and combustible modular cartridge 30 may be linked by a reversible attaching means. FIG. 3*d* shows a combustible modular cartridge base 20*b* with an igniter pad 35 which is in thermal contact with the combustible canister (not shown). In use a force is exerted on the igniter pad 35 causing an ignition, which is transferred to the propellant in the combustible canister. The energetic material inside the combustible canister 33 comprises an energetic material which undergoes an exothermic reaction causing a release of heat and gas. The concomitant flame front thus formed, travels in the gap 34 formed between the combustible canister 33 and the combustible modular cartridge wall 31.

Referring to FIGS. 4*a* and 4*b* there is a cross sectional view of a combustible modular cartridge 40 with a combustible modular cartridge wall 41, an internal combustible canister 43 comprising energetic material and a reversible attachment means 44 between said combustible modular cartridge wall 41 and combustible canister 43. FIGS. 4*a* and 4*b* both have protruding portions 46*a* and 46*b* and cooperative recessed portions 47*a* and 47*b* to enable cooperative engagement with successive combustible modular cartridges 40. This engagement may be a reversible means to enable a stronger link or a means of friction to prevent the combustible modular cartridge 40 from sliding apart. FIGS. 4*a* and 4*b* are examples, which show an arrangement where the protrusion portions 46*a/b* slides into the recessed portions 47*a/b* to enable controlled management of the combustible modular cartridge 40. This cooperative engagement may be independent of or including a charge container.

Referring to FIGS. 5*a* and 5*b* there is presented two potential arrangements of the top portion of the combustible modular cartridge. FIG. 5*a* is arranged with a substantial aperture 58 to aid in the propagation of a produced flame front, the combustible canister 56 can be seen internal to the combustible modular cartridge, with spacers 57 being achieved utilising a hook and loop system e.g. Velcro. These may be used to secure the combustible canister 56 to the combustible modular cartridge, while providing a gap 54 for the flame front to travel in.

FIG. 5*b* shows the top portion, with a recessed portion 55 to aid cooperative engagement with a further combustible modular cartridge with a cooperative raised portion (not shown) and a plurality of apertures 58 to aid in the propagation of a produced flame front.

Referring to FIG. 6 there is presented a cross-sectional view of a modular charge container 67, arranged by utilising a plurality of combustible modular cartridges 60. The modular charge container 67 is arranged in a stacked, coaxial arrangement, utilising a cooperative engagement means as identified in FIG. 4*a*. The base portion of the modular charge container 67 comprises an igniter pad 63 fitted to the combustible modular cartridge. In use the igniter pad 63 is struck, beginning the explosive chain through the combustible modular cartridges 60.

The invention claimed is:

1. A modular charge container device including a plurality of combustible modular cartridges configured to be cooperatively engaged with a further combustible modular cartridge, wherein each of the combustible modular cartridges comprises first and second ends, the first end of each of the combustible modular cartridges comprising a base portion including an igniter pad, the second end of each of the combustible modular cartridges comprising a top portion, wherein each of the combustible modular cartridges is constructed from a substantially rigid and combustible material, wherein each of the combustible modular cartridges comprises at least one wall to define a cavity, wherein the cavity of each of the combustible modular cartridges houses at least one combustible canister constructed from a flexible material, wherein the at least one combustible canister comprises a propellant material, wherein there is a gap between the at least one wall and the at least one combustible canister, such as to allow propagation of a flame front in the gap, and wherein at least one spacer is located in the gap between the at least one wall of each of the combustible modular cartridges and the at least one combustible canister.

2. The device according to claim 1, wherein the combustible canister is reversibly attached to the at least one wall.

3. The device according to claim 1, wherein the base portion comprises an aperture therein.

4. The device according to claim 1, wherein the top portion comprises an aperture therein.

5. The device according to claim 4, wherein the base portion comprises an aperture therein and wherein the base portion and the top portion each comprise a mating surface configured to provide cooperative engagement between the top portion of a first of the plurality of combustible modular cartridges and the base portion of a second of the plurality of combustible modular cartridges.

6. The device according to claim 5, wherein the mating surface of the top portion and the mating surface of the base portion each comprise a high co-efficient of friction, or at least one raised or recessed portion configured to retain engaged combustible modular cartridges.

7. The device according to claim 1, wherein the top portion of a first of the plurality of combustible modular cartridges and the base portion of a second of the plurality of combustible modular cartridges are reversibly locked together.

8. The device according to claim 7, wherein the top portion of a first of the plurality of combustible modular cartridges and the base portion of a second of the plurality of combustible modular cartridges are reversibly locked together by the use of a recessed bar and hook arrangement or twist lock arrangement.

9. The device according to claim 1, wherein at least two of the plurality of combustible modular cartridges each have the same dimensions and comprise the same mass of propellant material.

10. The device according to claim 1, wherein the flexible material includes a cotton cloth or a polyester cloth.

11. The device according to claim 1, wherein the propellant material includes a loose propellant material.

12. A method of forming a modular charge container, the modular charge container including a plurality of combustible modular cartridges, wherein each of the combustible modular cartridges comprises first and second ends, the first end of each of the combustible modular cartridges comprising a base portion including an igniter pad, the second end of each of the combustible modular cartridges comprising a top portion, wherein each of the combustible modular cartridges is constructed from a substantially rigid and combustible material, wherein each of the combustible modular cartridges comprises at least one wall to define a cavity, wherein the cavity of each of the combustible modular cartridges houses at least one combustible canister, wherein the at least one combustible canister is constructed from a flexible material, wherein the at least one combustible canister comprises a propellant material, wherein there is a gap between the at least one wall and the at least one combustible canister, such as to allow propagation of a flame front in the gap, and wherein at least one spacer is located in the gap between the at least one wall of each of the combustible modular cartridges and the at least one combustible canister, wherein the method comprises:

filling the at least one combustible canister with the propellant material; and locating the at least one combustible canister inside at least one of the combustible modular cartridges.

13. A modular charge container device including first and second combustible modular cartridges, each of the first and second combustible modular cartridges having a first end and a second end, the first end of each of the first and second combustible modular cartridges comprising a base portion including an igniter pad, the second end of each of the first and second combustible modular cartridges comprising a top portion, wherein each of the first and second combustible modular cartridges is constructed from a substantially rigid and combustible material, wherein each of the first and second combustible modular cartridges comprises at least one wall to define a cavity, wherein the cavity of each of the combustible modular cartridges houses a combustible canister, wherein the combustible canister comprises a propellant material, wherein there is a gap between the at least one wall and the combustible canister, such as to allow propagation of a flame front in the gap, and wherein at least one spacer is located in the gap between the at least one wall of each of the first and second combustible modular cartridges and the combustible canister.

14. The device according to claim 13, wherein the combustible canister is reversibly attached to the at least one wall.

15. The device according to claim 13, wherein the base portion comprises a base portion with an aperture therein, and the top portion comprises a top portion with an aperture therein, and wherein said base portion and top portion comprise a mating surface to provide cooperative engagement between said top portion of the first combustible modular cartridge and said base portion of the second combustible modular cartridge.

16. The device according to claim 13, wherein the combustible canister comprises a flexible material.

* * * * *